US007114996B2

(12) United States Patent
Goodman et al.

(10) Patent No.: US 7,114,996 B2
(45) Date of Patent: Oct. 3, 2006

(54) DOUBLE-POGO CONVERTER SOCKET TERMINAL

(75) Inventors: Glen Goodman, Cumberland, RI (US); James V. Murphy, North Kingston, RI (US)

(73) Assignee: Advanced Interconnections Corporation, West Warwick, RI (US)

( * ) Notice: Subject to any disclaimer, the term of this patent is extended or adjusted under 35 U.S.C. 154(b) by 0 days.

(21) Appl. No.: 10/935,996

(22) Filed: Sep. 8, 2004

(65) Prior Publication Data

US 2006/0052011 A1 Mar. 9, 2006

(51) Int. Cl.
*H01R 13/24* (2006.01)

(52) U.S. Cl. ..... 439/700

(58) Field of Classification Search ..... 439/700
See application file for complete search history.

(56) References Cited

U.S. PATENT DOCUMENTS

| | | | | |
|---|---|---|---|---|
| 4,442,938 | A | 4/1984 | Murphy | |
| RE32,540 | E | 11/1987 | Murphy | |
| 5,038,467 | A | 8/1991 | Murphy | |
| 5,088,930 | A | 2/1992 | Murphy | |
| 5,227,718 | A | 7/1993 | Stowers et al. | |
| 5,420,519 | A | 5/1995 | Stowers et al. | |
| 5,545,050 | A | 8/1996 | Sato et al. | |
| 5,576,631 | A | 11/1996 | Stowers et al. | |
| 5,877,554 | A | 3/1999 | Murphy | |
| 6,020,635 | A | 2/2000 | Murphy | |
| 6,213,787 | B1 | 2/2000 | Murphy | |
| 6,159,056 | A * | 12/2000 | Boyle | 439/700 |
| 6,204,680 | B1 | 3/2001 | Swart et al. | |
| 6,313,530 | B1 | 11/2001 | Murphy | |
| 6,352,437 | B1 | 3/2002 | Tate | |
| 6,464,511 | B1 | 10/2002 | Watanabe et al. | |
| 6,471,524 | B1 | 10/2002 | Nakano | |

OTHER PUBLICATIONS

International search report for PCT/US05/28248 dated Dec. 27, 2005.

* cited by examiner

*Primary Examiner*—Truc Nguyen
(74) *Attorney, Agent, or Firm*—Fish & Richardson P.C.

(57) ABSTRACT

A socket terminal assembly includes a socket body having a first end with a first opening to receive a contact element and a second opening at a second end to receive a pin. A contact element, located in the first opening, is configured to contact the corresponding connection region of a printed circuit board; a pin has an end adapted to contact an electrical contacting area of an integrated circuit package and an opposite end configured to be inserted within the opening of the socket body. A contact spring in the second opening receives the pin and applies a frictional force sufficient to retain the lower end of the pin within the opening of the socket body. A resilient member is disposed within the opening between the contact element and the contact spring. The resilient member applies to the pin and contact element, in response to a downward force applied to the pin or an upward force applied to the contact element, a force sufficient to overcome the frictional force of the contact spring. An intercoupling component includes a socket support member having holes, each hole receiving a corresponding socket terminal assembly.

26 Claims, 7 Drawing Sheets

DOUBLE-POGO CONVERTER SOCKET TERMINAL

BACKGROUND OF THE INVENTION

This invention relates to making connections between integrated circuit array packages (IC) and circuit boards.

Ball grid array (BGA) and land grid array (LGA) packages are becoming increasingly popular because of their low profiles and high densities. With a BGA package, for example, the rounded solder balls of the BGA are generally soldered directly to corresponding surface mount pads of a printed circuit board rather than to plated thru-holes which receive pins from, for example, a pin grid array IC package.

Sockets are used to allow particular IC packages to be interchanged without permanent connection to a circuit board. More recently, sockets for use with BGA and LGA packages have been developed to allow these packages to be non-permanently connected (e.g., for testing) to a circuit board. Problems associated with attaching a BGA package to conventional sockets are discussed in U.S. Pat. No. 5,877,554, which is incorporated herein by reference. However, some of the same problems exist in attaching the socket to the circuit board. These problems occur because a BGA package presents a non-traditional mating condition. The rounded solder balls of the BGA are relatively poor points of contact for temporary connection to the circuit board and are suited oily for their intended purpose of being reflowed. Further, individual points of contact for each rounded solder ball may lack co-planarity on account of ball irregularities and warping of the circuit board.

SUMMARY OF THE INVENTION

This invention features a socket terminal assembly which provides a reliable, non-permanent and low-loss electrical interconnection between electrical contacting areas of an array package and connection regions of a substrate (e.g., printed circuit board). The term "integrated circuit array package" is intended to mean those packages, including PGA (pin grid array), BGA and LGA packages. The term "substrate" is intended to mean any base member having electrical contact areas including printed circuit boards, IC chip substrates or the packages supporting such chip substrates.

In general, the invention relates to a socket terminal assembly of the type configured to electrically connect an electrical contacting area of an integrated circuit package to a corresponding connection region of a substrate.

In one aspect of the invention, the socket terminal assembly includes a socket body, having a first end with a first opening to receive a contact element and an opposite end with a second opening to receive a pin. The contact element is located in the first opening of the socket body. A contact spring in the second opening of the socket body receives the pin and applies a frictional force sufficient to retain it within the opening of the socket body. A resilient member is disposed within the socket body between the contact spring and the contact element.

In another aspect of the invention, an intercoupling component (e.g., a socket assembly) includes a number of socket terminal assemblies, of the type described above, received within openings in an insulative socket support member. The openings extend from the upper surface to the lower surface of the support member and are located in a pattern corresponding to the pattern of connection contacts in a substrate. The socket terminal assemblies are configured to electrically connect the electrical contacting areas of an integrated circuit array package with the array of connection regions of the substrate.

An intercoupling component having this arrangement eliminates the need for soldering the package directly to a circuit board (e.g., motherboard) and allows removing the integrated circuit array package in situations where the package needs to be repaired or replaced. Likewise, the contact elements of the socket terminal assemblies eliminate the need for soldering the intercoupling component itself to the circuit board, providing similar advantages.

Embodiments of these aspects of the invention may include one or more of the following features. The contact element is configured to contact a corresponding connection region of a printed circuit board or other substrate. This contact element provides the electrical connection between the substrate and the socket terminal assembly. The contact element has a flange which retains it within the first opening of the socket body. The contact element is configured to contact the sides of the socket. For example, the contact element has a groove defining two halves which expand apart, keeping them in contact with the socket. For another example, the contact is hollow and formed from thin material which is spring-fit and which contacts the sides of the socket. The contact spring is configured to provide a "wiping," reliable electrical contact in which the frictional force is substantially transverse to the upward force applied by the resilient member. For example, the contact spring includes at least one resilient spring finger which frictionally engages the lower end of the pin.

The resilient member applies, in response to a downward force applied to the pin, an upward force to the pin sufficient to overcome the frictional force of the contact spring, and in response to an upward force on the contact element, a downward force sufficient to maintain the position of that element. The resilient member is in the form of a coiled conductive spring, or alternatively, in the form of an elastomeric material (e.g., rubber). The contact element may have a blunt tip that makes direct contact with the conductive portion of the circuit board. Alternatively, the contact element may have a sharpened point to pierce an oxidation layer or other coating that would otherwise prevent electrical connection to the circuit board. Additional contact element tip configurations are also possible.

The pin is adapted to contact the electrical contacting area of the integrated circuit array package. For integrated circuit array packages having ball-shaped contacts, the upper end of the pin may include a concave ball-contacting surface to receive a ball-shaped contact. A sharp protuberance extending from the ball-contacting surface may be provided to pierce the surface of the ball-shaped contact. The sharp protuberance is conically-shaped and disposed along the longitudinal axis of the pin. In other embodiments, the sharp protuberance may be ring-shaped and disposed concentric with the longitudinal axis. Alternatively, the upper end of the pin may include particle interconnections.

Embodiments of the intercoupling component aspect of the invention may include one or more of the following features. The intercoupling component includes an electrically insulative sheet coupled to the pins of the socket terminal assemblies and having holes arranged in the pattern of the connection contacts of the substrate. The sheet is formed, for example, of a polyimide film and adapted to retain the pins in a ganged arrangement. The intercoupling component includes a guide member to align the integrated circuit array package with the array of socket terminal assemblies, and a member which applies a downward force on the contact area of the integrated circuit package and to each pin to cause the resilient member to compress. The member applying downward force includes a heat sink threadingly received within a cover positioned over the integrated circuit package. The socket support member includes a member which attaches the socket to the printed circuit board or other substrate, and applies, via the pins and the resilient member, a downward force to the contact elements, causing them to maintain contact with the connection contacts on the substrate.

Other features of the invention will be apparent from the following description of the preferred embodiments and from the claims.

DESCRIPTION

Figure 1:
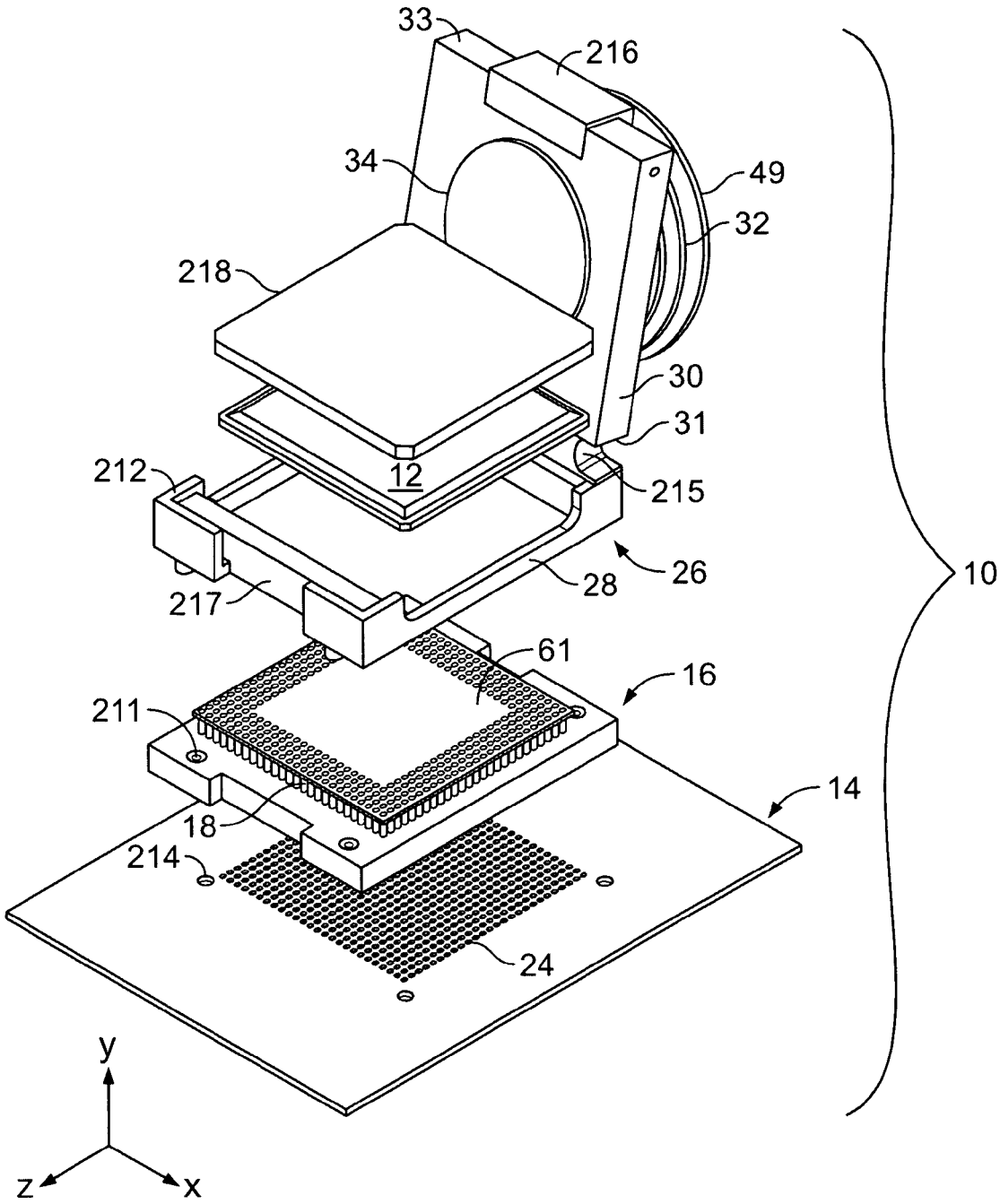
FIG. 1 is an exploded, diagrammatic, isometric view of a BGA converter socket assembly, a BGA package, and hold-down assembly positioned over a printed circuit board.

Referring to FIG. 1, a BGA socket converter assembly 10 for intercoupling a BGA package 12 to a printed circuit board 14 is shown. BGA socket converter assembly 10, serving as an intercoupling component, includes an electrically insulative member 16 for supporting converter socket terminals 18, each of which is press-fit within a corresponding one of an array of holes 20 (FIG. 3) in the insulative member. The array of holes 20 are provided in a pattern corresponding to a footprint of rounded solder balls 22 (FIG. 6B) of BGA package 12 as well as a footprint of surface mount pads 24 of printed circuit board 14. Insulative member 16 with converter socket terminals 18 is positioned below guide box 26 having sidewalls 28 along which the peripheral edges of BGA package 12 are guided so that solder balls 22 are aligned over converter socket terminals 18. In some embodiments, insulative member 16 and guide box 26 may be formed as a one-piece, integral unit.

BGA socket converter assembly 10 also includes a hold-down cover 30 for securing the BGA package 12 into the socket converter assembly. Hold-down cover 30 includes an edge 31 connected to guide box 26 via a hinge structure 215 and an opposite edge 33 having a tab member 216 which engages the recessed portion 217 of guide box 26. Hold-down cover 30 includes a threaded thru-hole 34 which threadingly receives a heat sink 32 to provide a thermal path for dissipating heat from the IC device generated within BGA package 12. Heat sink 32 is inserted from the top of cover 30 and includes a lip 49 which limits the extent to which heat sink 32 can be threaded into cover 30. A slot 36 (FIG. 6B) formed in the heat sink is used to thread the heat sink within the cover, for example, with a screwdriver or coin. Spacer 218 distributes the load from heat sink 32 evenly over BGA package 12. Other latching mechanisms (e.g., clips or catches) may also be used to secure BGA packages within the socket converter assembly. It is also appreciated that other heat sink arrangements, including those with increased surface area (e.g., heat sinks with finned arrangements), may be substituted for the version shown in FIG. 1. In some applications, a heat sink may not be required so that only the cover providing the downward compressing force to the BGA package. Guide box 26 and cover 30 are attached to circuit board 14 by inserting bolts 210 (FIG. 3) through holes 211 and 212, respectively in insulative member 16 and guide box 26 and corresponding holes 214 in circuit board 14. Other attachment mechanisms may also be used to attach the socket assembly to the printed circuit board.

Figure 2:
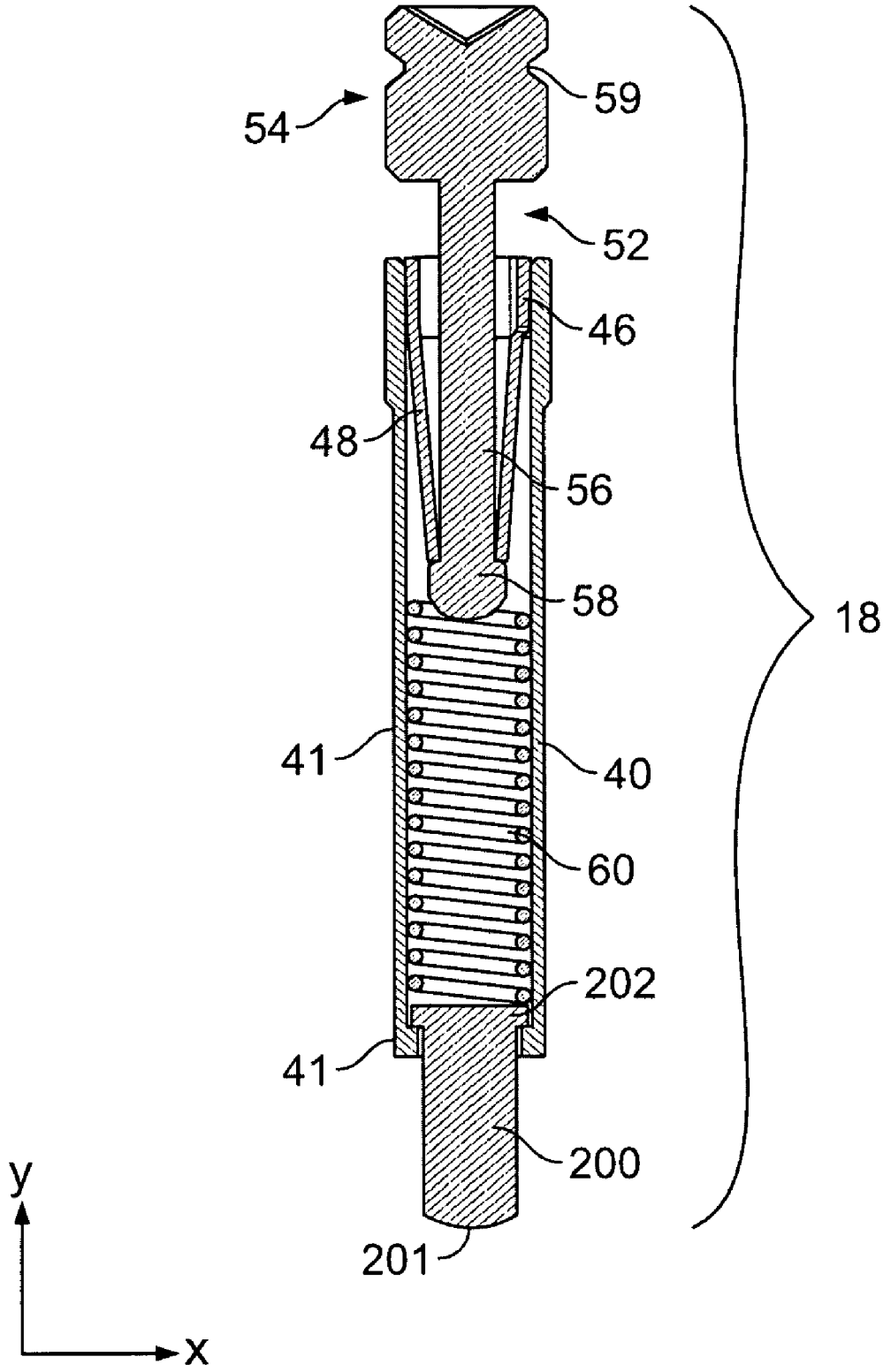
FIG. 2 is a cross-sectional side view of a single converter socket of FIG. 1.
Figure 3:
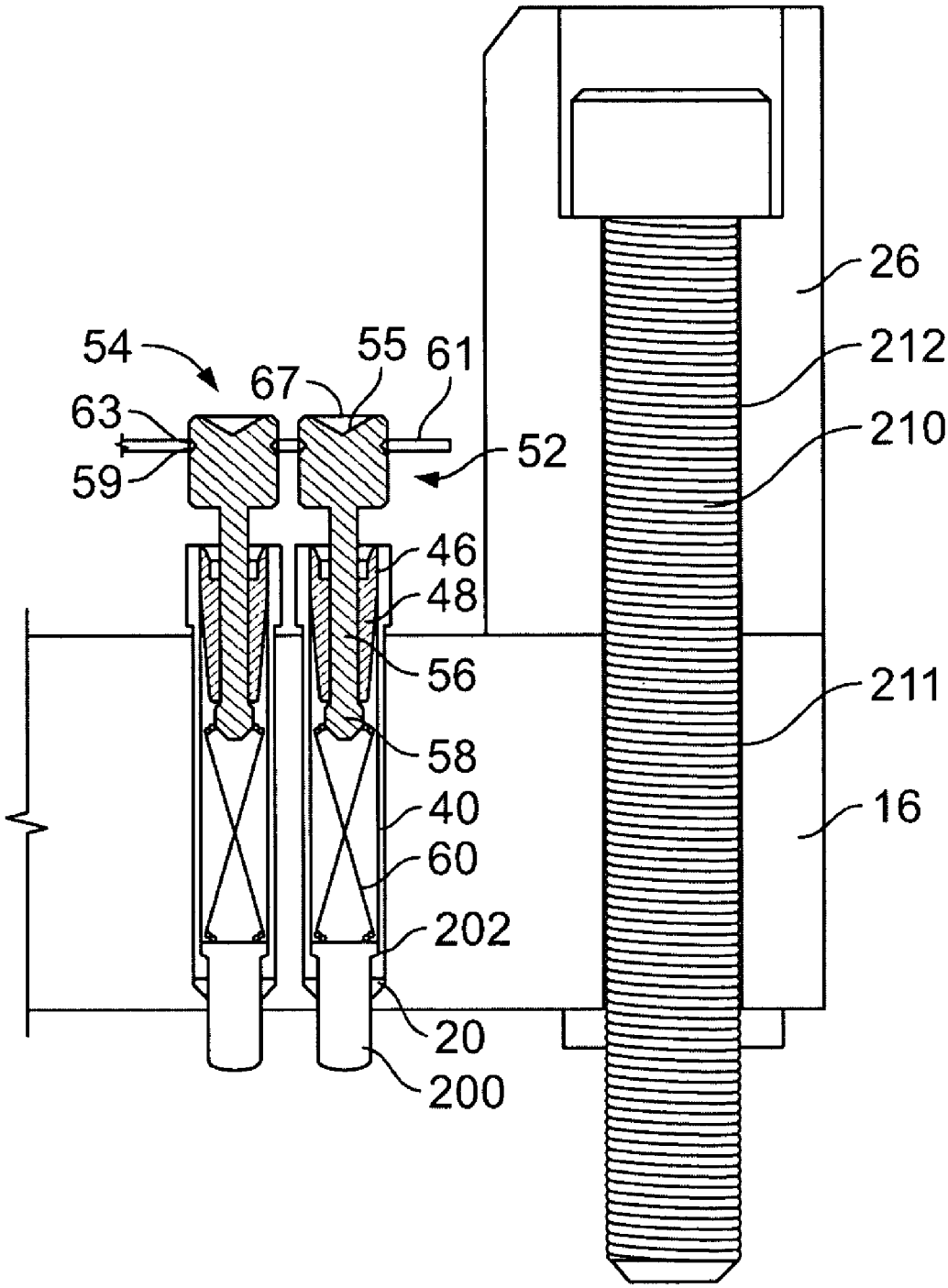
FIG. 3 is a cross-sectional side view of a portion of the BGA converter socket assembly of FIG. 1.

Referring to FIG. 2 and FIG. 3, each converter socket terminal 18 includes a female socket 40 positioned within one of the array of holes 20 of insulative member 16. Protrusions 41 on the surface of socket 40 retain socket 40 within insulative member 16. Positioned within the interior of female socket 40 is a contact element 200, which protrudes through the openings at the lower ends of the socket 40 and hole 20. Contact element 200 is prevented from exiting socket 40 by flange 202. The tip 201 of contact element 200 may be blunt or pointed (not shown) or have other shapes as appropriate for making electrical contact with surface mount pads 24. Also positioned within the interior of female socket 40 is a contact spring 46 press-fit within the interior and upper end of the female socket. Bolt 210 is positioned within holes 211 and 212, respectively through insulative member 16 and guide box 26.

Figure 4:
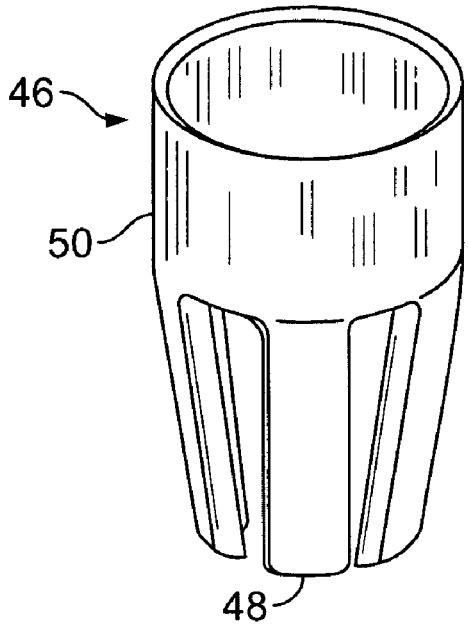
FIG. 4 is a perspective view of a contact spring of the BGA converter socket of FIG. 3.

Referring to FIGS. 2–4, each contact spring 46 includes spring leaves 48 attached at circumferentially spaced points of the lower end of a barrel 50. Contact spring 46 is sized to receive a male terminal 52 which passes through barrel 50 to frictionally engage spring leaves 48. Contact springs of this type are commercially available from Advanced Interconnections®, West Warwick, R.I. or other stamping outfits that provide such contact springs (e.g., in an open-tooling arrangement). Spring leaves 48 provide a "wiping," reliable, electrical contact to the male terminal pins by applying a frictional force in a direction substantially transverse to the longitudinal axis of the male terminals sufficient to retain the pin within the socket body.

Each male terminal 52 has a pin 56 and a head 54 adapted to receive a corresponding ball 22 (FIG. 6B) of the BGA package 12, thereby forming an electrical connection between ball 22 of package 12 and contact element 200 of converter socket terminal 18, through terminal 52 and metallic coiled springs 60 (shown schematically in FIG. 3). Head 54 has a concave upper surface 55 for accommodating the rounded shape of solder ball 22.

Referring again to FIG. 3 and FIG. 5, a relatively sharp projection 57 may be disposed concentrically on the concave upper surface 55 of head 54. Projection 57 is used to pierce the outer surface of the BGA package's solder balls 22 (FIG. 6B) which, due to exposure to the atmosphere, may have a layer of oxidation. Projection 57 is positioned at the lowest point within concave upper surface 55 with the tip of projection 57 substantially below the plane defined by the outer peripheral edge 67 of head 54. Thus, projection 57 is protected during tumbling operations, commonly performed on machine parts to remove sharp and irregular edges.

Figure 5:
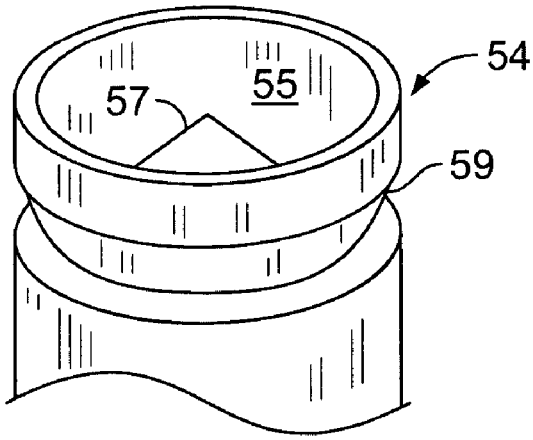
FIG. 5 is a perspective view of the head region of a pin which receives the solder balls of the BGA package of FIG. 1.

Referring to FIG. 5, in an alternative embodiment, contacting surfaces of head 54*a* include particle interconnection (PI) 53 contacts. As described in U.S. Pat. No. 5,083,697 (incorporated herein by reference), particle interconnection contacts 53 include relatively hard metallized particles deposited in a soft metal layer such that they protrude from the surface of the contact. When a second contacting surface (e.g., ball) is compressively brought into contact with the PI contact, the hard particles penetrate any oxides and contamination present on the contacting surface. PI contacts minimize the resistance between the contacts, particularly after repeated insertions. Alternatively, a dendritic growth process may be used to improve the conductivity between contacts.

Referring again to FIG. 2 and FIG. 3, head 54 of each male terminal 52 also includes a V-groove 59 used to capture a relatively thin polymeric sheet 61 made, for example, from Kapton® (a product of E.I. DuPont de Nemours and Co., Wilmington, Del.). Sheet 61 includes openings 63 sized slightly smaller than the diameter of the heads 54. This arrangement maintains male terminals 52 together in proper spaced relationship so that the pins can be easily aligned over and inserted into female sockets 40. Sheet 61 also prevents tilting of the pins which can cause electrical shorting.

Each of pins 56 are received within corresponding contact springs 46 with spring leaves 48 configured to provide a lateral force, generally transverse to the longitudinal axis of pins 56, thereby frictionally engaging outer surfaces of the pins.

In one embodiment, the lower end of pin 56 includes a flattened head 58 having a diameter slightly larger than the diameter of pin 56 so that after head 58 passes through spring leaves 48 of contact spring 46, male terminal 52 is captured within female socket 40.

Metallic coiled springs 60 are loosely positioned within the interiors of each of female sockets 40 and provide an upward force to the lower ends of pins 56 and a downward force to the upper ends of contact elements 200. As mentioned earlier, spring leaves 48 of contact springs 46 provide a sufficient amount of lateral frictional force generally transverse to the longitudinal axis of the pins, in order to ensure a reliable electrical contact to pins 56 of male terminals 52. However, when the socket is removed from the circuit board, metallic coiled springs 60 expand causing each of contact elements 200 to extend to their lowest position within female sockets 40. Also, when hold-down cover 30 (FIG. 6B) is released from guide box 26, metallic coiled springs 60 expand causing each of male terminals 52 to release and extend to their most vertical position within female sockets 40. Thus, coiled springs 60 must provide an upward force to male terminal pins 52 that overcomes the frictional force, transverse to the upward force, applied by spring leaves 48. The upward force of coiled springs 60 also minimizes the risk of pins 56 "sticking" within corresponding female sockets 40.

Figure 6A:
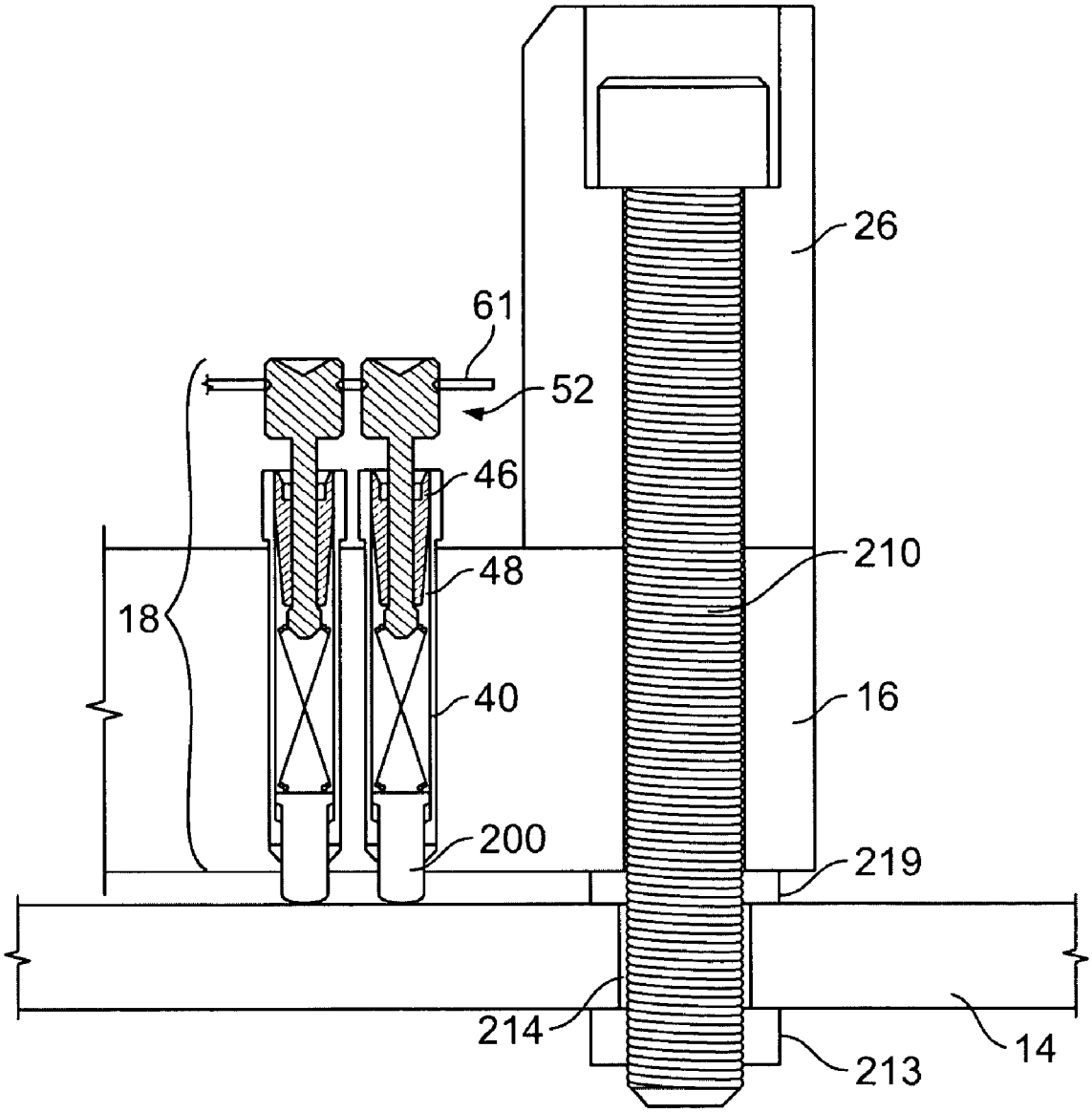
FIGS. 6A–6B are cross-sectional side views of the operation of the BGA converter socket assembly.
Figure 6B:
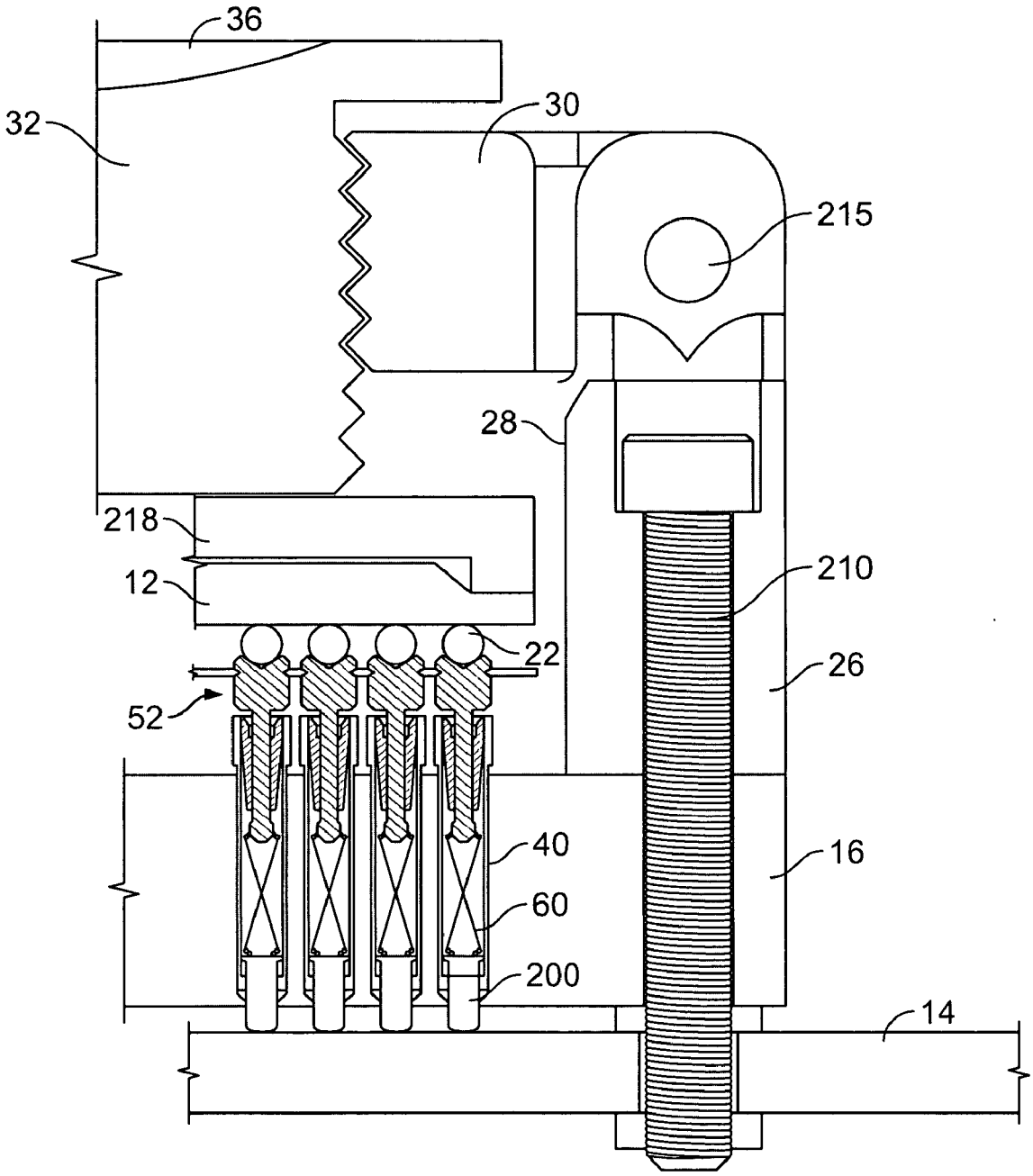

With reference to FIGS. 6A and 6B, the operation of converter socket terminals 18 will be discussed. Referring to FIG. 6A, male terminals 52 vertically extend to their greatest degree from contact springs 46. Guide box 26 and insulative member 16 are held in place by bolt 210 which is positioned through standoff 219 and hole 214 in circuit board 14, and held in place by nut 213.

Figure 5A:
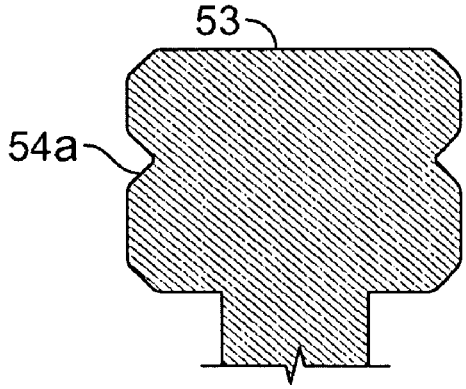
FIG. 5A is a cross-sectional side view of an alternative embodiment of the head region of a pin.

Referring to FIG. 6B, BGA package 12 is positioned within guide box 26, using sidewalls 28 of guide box 26, and over insulative member 16 with solder balls 22 of BGA package 12 resting on concave upper surface 55 (FIG. 3) of male terminals 52. Hold-down cover 30 is shown in place with heat sink 32 positioned over spacer 218 and BGA package 12. Cover 30 is attached to guide box 26 through hinge 215 and held down by tab 216 (FIG. 1). Heat sink 32 is rotated within cover 30 using slot 36 until the heat sink contacts the upper surface of spacer 218, which in turn contacts the upper surface of BGA package 12. Further rotation of heat sink 32 causes male terminal pins 52 to extend within female sockets 40 and against the bias of coiled springs 60. Thus, electrical interconnections are completed from each of solder balls 22 of BGA package 12 to corresponding pads 24 (FIG. 1) of board 14, through terminals 52, coiled sprigs 60, and contact elements 200. Raising heat sink 32 from cover 30 removes the downward force applied to BGA package 12 with spring coils 60 returning male terminal pins 52 to their fully extended vertical position of FIG. 5A. With heat sink 32 in its raised position, cover 30 can be removed to allow, for example, substituting a different BGA package within the BGA converter socket assembly. The likelihood that one or more of male terminal pins 52 becomes stuck within female socket 40 is minimized because the pins are "ganged" together by polymeric sheet 61, which assists in ensuring that all of the pins return to their vertically extended position and at a consistent height. It is also important to note that each time a BGA package is secured within BGA socket converter assembly 10, pins 56 of male terminals 52 are "wiped" against spring leaves 48 of contact spring 46 to remove oxidation and ensure a reliable electrical connection therebetween.

Referring to FIGS. 7A–7D, alternative embodiments of contact element 200 for improving the reliability between terminal 52 and contact element 200 are shown. Referring again to FIG. 2, terminal 52 is electrically connected to contact element 200 through coiled spring 60. A potentially less reliable electrical path between terminal 52 and contact element 200 extends through spring leaves 48 and the body of socket 40. To improve the electrical reliability of this connection, the contact element can be formed with spring-like characteristics.

Figure 7A:
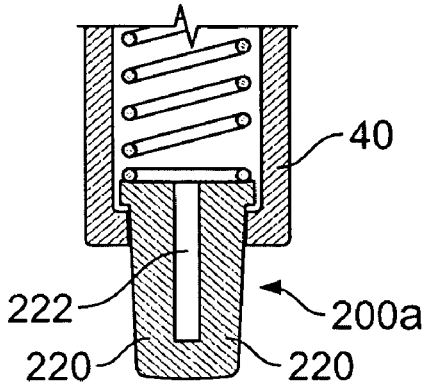
FIGS. 7A–7D are cross-sectional and isometric views of alternative embodiments of a contact element.
Figure 7B:
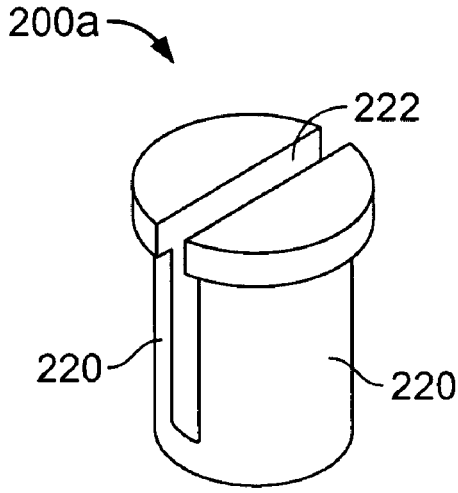

For example, referring to FIGS. 7A and 7B, contact element 200*a* includes a slot or groove 222 that defines a pair of spring-like halves 220. When contact element 200*a* is inserted within the opening at the lower end of socket 40, the two halves 220 of contact element 200*a* are compressed together. Once within the opening, the two halves 220 expand to make contact with the side walls of socket 40, thereby improving the reliability of the connection between contact element 200*a* and the body of socket 40.

Figure 7C:
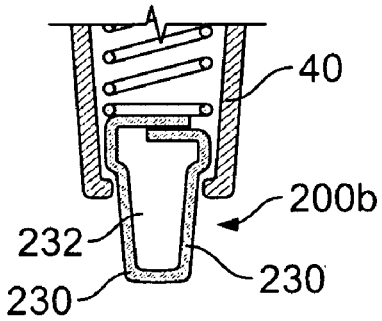
Figure 7D:
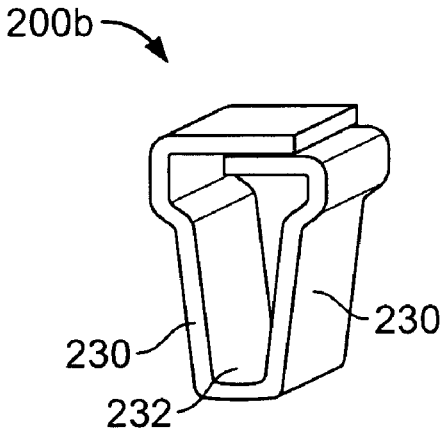

Referring to FIGS. 7C and 7D, in another example, contact element 200*b* is made from sheet metal or another thin material, forms two sides 230 around hollow space 232, and is spring-fit so that sides 230 push against the side walls of socket 40.

Other embodiments are within the following claims. For example, the socket assembly may be attached to the circuit board by clips or catches, rather than by a bolt or nut. The contact element may be adapted to make contact with the contact pads in different ways depending on the nature of the circuit board.

It is also appreciated that in the above described embodiments, other forms of spring members may be substituted for coiled springs 60 (FIG. 2). For example, spring-like members formed of elastomeric (e.g., rubber) or shape-memory materials may be used to provide the necessary upward force needed to overcome the frictional forces of contact springs 46 and downward force needed to keep contact element 200 in contact with contact pads 24.

Still further embodiments are supported by the following claims.

What is claimed is:

1. A socket terminal assembly of the type configured to electrically connect an electrical contacting area of an integrated circuit package to a corresponding connection region of a substrate and comprising:

a socket body having a first end with a first opening to receive a contact element, the socket body having an opposite end with a second opening configured to receive an end of a pin;

a contact element, disposed at the first opening of the socket body;

a contact spring, disposed at the second opening of the socket body, to receive and apply a frictional force sufficient to retain the pin within the opening of the socket body; and a resilient member, disposed within the socket body and between the contact spring and contact element.

2. The socket terminal assembly of claim 1 wherein the contact element includes an end configured to contact a corresponding connection region of the substrate.

3. The socket terminal assembly of claim 1 wherein the contact element includes a flange configured to retain the contact element within the first opening of the socket body.

4. The socket terminal assembly of claim 1 wherein the contact spring is configured to apply frictional force in a direction substantially transverse to the direction of the upward force applied by the resilient member.

5. The socket terminal assembly of claim 4 wherein the contact spring includes at least one resilient spring finger.

6. The socket terminal assembly of claim 1 wherein the resilient member includes a coiled conductive spring.

7. The socket terminal assembly of claim 1 wherein the resilient member is formed of an elastomeric material.

8. The socket terminal assembly of claim 1 wherein the contact element is configured to contact the sides of the socket body.

9. The socket terminal assembly of claim 8 wherein the contact element includes a slot.

10. The socket terminal assembly of claim 8 wherein the contact element is hollow.

11. The socket terminal assembly of claim 1 further comprising the pin.

12. The socket terminal assembly of claim 11 wherein the electrical contacting area of the integrated circuit is a ball-shaped contact and the opposite end of the pin includes a concave ball-contacting surface to receive the ball-shaped contact.

13. The socket terminal assembly of claim 12 further comprising a sharp protuberance extending from the ball-contacting surface to pierce the surface of the ball-shaped contact.

14. The socket terminal assembly of claim 13 wherein the pin includes a longitudinal axis and the sharp protuberance is conically-shaped and disposed along the longitudinal axis.

15. The socket terminal assembly of claim 13 wherein the pin includes a longitudinal axis and the sharp protuberance is ring-shaped and disposed concentric with the longitudinal axis.

16. The socket terminal assembly of claim 1 further comprising particle interconnections disposed on the opposite end of the pin.

17. An intercoupling component comprising at least one socket terminal assembly as recited in claim 11; and a socket support member including openings extending therethrough from an upper surface to an opposite lower surface, the openings located in a pattern corresponding to a pattern of connection contacts, each opening configured to receive the at least one socket terminal assembly.

18. The intercoupling component of claim 17 further comprising a plurality of socket terminal assemblies, each socket terminal assembly received within a corresponding opening of the socket support member.

19. The intercoupling component of claim 18 further comprising an electrically insulative sheet coupled to pins of the socket terminal assemblies, the insulative sheet having a plurality of holes arranged in a pattern corresponding to the pattern of the connection contacts, each hole adapted to retain the pins.

20. The intercoupling component of claim 19 wherein the retaining sheet is a polyimide film.

21. The intercoupling component of claim 18 further comprising a guide member.

22. The intercoupling component of claim 21 further comprising a member for applying a downward force on the contact area of the integrated circuit package and to each pin to cause the resilient member to compress.

23. The intercoupling component of claim 22 wherein the member for applying the downward force comprises a heat sink threadingly received within a cover positioned over the integrated circuit package.

24. The intercoupling component of claim 22 wherein the guide member comprises attachment elements for positioning the member for applying downward force.

25. The intercoupling component of claim 21 wherein the guide member comprises alignment elements to align the contacting area of the integrated circuit package with the array of socket terminal assemblies.

26. The intercoupling component of claim 22 further comprising a member for attaching the intercoupling component to a substrate and wherein the downward force is further applied to each contact element.

* * * * *